US005291835A

United States Patent [19]

Wicks

[11] Patent Number: 5,291,835

[45] Date of Patent: Mar. 8, 1994

[54] RETRACTABLE INTERMODAL VEHICLE

[75] Inventor: Harry O. Wicks, El Paso, Tex.

[73] Assignee: RailRunner Systems, Inc., Griffin, Ga.

[21] Appl. No.: 37,040

[22] Filed: Mar. 25, 1993

[51] Int. Cl.[5] ..... B61F 3/12

[52] U.S. Cl. ..... 105/4.2; 105/4.4; 105/159; 410/53

[58] Field of Search ..... 105/4.1, 4.2, 4.4, 159, 105/199.1, 199.2, 215.2; 410/53, 56, 57

[56] References Cited

U.S. PATENT DOCUMENTS

| | | | |
|---|---|---|---|
| 4,202,276 | 5/1980 | Browne et al. | 105/215.2 X |
| 4,753,174 | 6/1988 | Berg et al. | 105/226 |
| 4,955,144 | 9/1990 | Lienard et al. | 105/4.2 |
| 5,009,169 | 4/1991 | Viens | 105/4.1 |
| 5,020,445 | 6/1991 | Adams, Jr. | 105/4.1 |
| 5,040,466 | 8/1991 | Wicks et al. | 410/53 X |
| 5,107,772 | 4/1992 | Viens | 105/4.2 X |
| 5,199,359 | 4/1993 | Bedard et al. | 105/168 |

FOREIGN PATENT DOCUMENTS

| | | | |
|---|---|---|---|
| 2051272 | 10/1979 | Fed. Rep. of Germany . | |
| 47672 | 2/1989 | Japan | 105/199.2 |

*Primary Examiner*—Andres Kashnikow
*Assistant Examiner*—S. Joseph Morano
*Attorney, Agent, or Firm*—John C. Thompson

[57] ABSTRACT

A retractable intermodal vehicle for supporting and connecting modified semitrailers end-to-end to form a train of trailers capable of being operated on a railroad track; the semitrailers also able to be operated on a highway as regular semitrailers. The intermodal vehicle is comprised of two lower frames, with a wheel/axle assembly mounted to each, and each pivoted from and supporting a single upper frame assembly; the pivoting of these lower frames providing a limited steering of the rail axles relative to the upper frame. Inflatable air springs are mounted between the lower frames and upper frame assembly to allow the upper frame to be raised and lowered. The upper frame assembly is comprised of two gravity load carrying structures, each for supporting one end of a superimposed trailer; two coupler bodies, each containing a coupler tongue, the tongue being arranged to enter a complimentary coupler tongue receiving socket at either end of the superimposed trailer; and two upwardly movable coupling pins, each pin capable of being raised to enter concentric apertures in a coupler tongue and an a complimentary trailer mounted socket to effect a coupling between these elements; and each pin being capable of being lowered to permit the withdrawal of the coupler tongue from the trailer socket. In an alternative design two separate upper frames are provided.

20 Claims, 9 Drawing Sheets

RETRACTABLE INTERMODAL VEHICLE

This invention deals with improvements in detachable intermodal rail adapting vehicles such as that shown in U.S. Pat. Nos. 5,040,466, 4,955,144 and 5,107,772.

This prior art describes means whereby a train of highway trailers can be assembled into a train of rail cars by coupling them together and attaching to them removable rail bogies with wheels appropriate to rail travel; said rail bogies being detached when the trailers are to be used as normal highway units.

In the prior art of U.S. Pat. No. 5,040,466, the coupling means between the trailers when used in the rail mode is of a style which includes a forward projecting (male) coupling tongue at the front of each trailer and a complimentary (female) socket at the rear of each trailer, together with a vertical pin passing through both the tongue and the socket to effect a coupling between them.

In this prior art, a standard three-piece rail truck is surmounted by an adapter pedestal unit. Said adapter pedestal unit is mounted within the center of the rail truck bolster in the same way that corresponding elements of a rail car would be mounted. That is, it has a circular flat center plate at its lower surface, with said center plate riding within the central "bowl" which is part of the railtruck bolster. It thus has the ability to rotate and rock as required by the motions of the car traveling on the track. The railtruck is equipped with normal coil springs which are able to deflect as required by the superimposed load. In order to mount the railtruck/adapter combination beneath the rear of a highway trailer for use on the rails, it is necessary that the rear of the trailer be raised enough for the insertion of said railtruck/adapter unit. Additionally, it is also necessary that the adapter be high enough to ensure that once the loaded trailer is placed upon it, the deflecting under load of the rail truck springs will not allow the suspended highway wheels of the trailer to touch the railroad track. The usual method for raising the trailer to mount it to the railtruck/adapter is by the use of an air-spring highway suspension on the trailer. This trailer suspension system, such as that manufactured by Nu-Way, Granning or Fruehauf, is customarily arranged to allow for the injection of excess air into the springs; said excess air causing the rear of a trailer so equipped to be lifted above its normal highway operating height to allow the railtruck/adapter unit to be placed beneath it. This air-spring highway suspension unit also has the ability to retract its axles still further once the railtruck-/adapter unit is in place, thus raising the highway wheels clear of the tracks. Other methods for raising the trailers are also used acceptable. For example, it is also practical to simply lift the rear of the trailer by external or internal mechanical or hydraulic means, or by the use of a ramp for the trailer wheels. Placing the railtruck-/adapter unit in a depressed track, or lowering it with a lift table will also permit the trailer to be backed over it.

In the prior art of U.S. Pat. No. 5,107,772, a special railtruck is described. This special railtruck is comprised of a rail-wheel mounted chassis and a frame mounted above this chassis. This frame has attached to it, two "fifth wheel" units such as those normally found on a conventional highway tractor used for pulling semi-trailers. Trailers used with this railtruck are fitted with vertical, downward-projecting kingpins; one at each end of the trailers. In use, the trailers are backed over the fifth wheel units so that the kingpins enter the apertures of the fifth wheels. The rail wheels of this special railtruck are air-sprung, but the rail wheels are not steerable along the railroad track.

It has been mathematically proved that the kingpin/-fifth-wheel combination above described does not have sufficient strength to pull safely more than (perhaps) six trailers at best. This is in part because the kingpin is in a single-shear arrangement. This inadequacy of kingpin strength is made up for by the use of intermediate traction units interspersed along the train, as shown in U.S. Pat. No. 5,107,772 and further in U.S. Pat. No. 5,009,169.

U.S. Pat. No. 4,955,144 also describes an intermodal railtruck unit which is detachable from specially-constructed trailers. The railtruck unit is equipped with two transverse bolsters, each of which is of a width to receive and support either end of a semitrailer or I.S.O. container; said trailers or containers being attached to the aforesaid transverse bolsters by vertically-oriented, upwardly projecting twist-lock fittings near the outer ends of said bolsters, and similar to those customarily used in the attachment of I.S.O. containers to each other and to ships or railroad cars transporting them. These twist-lock fittings are in a single-shear arrangement with respect to the trailer supporting bolsters. As in the case of the kingpins used in U.S. Pat. No. 5,107,772 described above, this single shear arrangement can be mathematically proved to be of insufficient strength to pull a train safely. U.S. Pat. No. 4,955,144 further describes the railtrucks used with this system as having a "rigid chassis." A railtruck having a rigid chassis is incapable of providing any steering of the individual rail axles. Additionally, the Patent describes a train makeup and breakup procedure wherein the trailers and/or containers are lifted into position by an overhead crane into position atop the railtruck bolsters; over the upwardly-projecting twist-lock fittings located near the ends of said transverse trailer support bolsters. No procedure for train makeup or breakup other than lifting the trailers is described.

In all of the above prior art, disadvantages can be identified. For example, the requirement that the rear of the trailers must be lifted or that the railtruck/adapters must be lowered for attachment beneath the trailers requires equipment which adds weight to the trailer, as does the inclusion of a coupler tongue and a coupler socket as part of the trailer structure. The use of fittings such as kingpins or twist-locks for pulling a train of rail cards is not a structurally-sound practice. Further, it is highly desirable that modern railtrucks have a capability for limited axle steering in order that they can perform more safely on poor tracks and at higher speeds on good tracks.

It is therefore, one purpose of this invention to provide a detachable Retractable Intermodal Vehicle which attaches below a trailer as described in prior art, but which will retract or "squat" in order that the trailer can be backed over it for attachment thereto while resting on its highway wheels in the normal position; said Retractable Intermodal Vehicle also having the ability to rise in order to lift the rear of the trailer sufficiently for the highway wheels to clear the tracks when the trailer is riding on the railroad atop the Retractable Intermodal Vehicle as one unit of a train of trailers.

It is another purpose of this invention to provide a Retractable Intermodal Vehicle which uses air springs with a self-levelling feature to keep the body of the trailer surmounting it at a more or less constant height while it is riding on the railroad track.

It is another purpose of this invention to provide a Retractable Intermodal Vehicle which has limited steering of its individual rail axles to help prevent the condition known as "hunting" of the rail wheels, i.e., the attempt of the wheels of a railtruck to find a true path along the rails as it rides thereon, and to help prevent "wheel climbing", the tendency for a railroad wheel to go off the track.

Another purpose of this invention is to provide a Retractable Intermodal Vehicle which in its suspension system provides a limited amount of "longitudinal resiliency" in its springing system in order to lessen the transmission of longitudinal shock loads into the trailer superimposed thereon due to irregularities in the surface of the rails.

Still another purpose is to provide a Retractable Intermodal Vehicle which includes a simple, truck mounted direct-acting braking system.

A further purpose of this invention is to provide a simplified means for coupling the trailers end-to-end for use in the rail mode, while at the same time reducing stresses on the trailer structure by providing a means for supporting the trailer other than by the use of a coupling tongue and socket arrangement, but at the same time providing a coupling which is "slackless" and which provides for steering of the trailer as well as for limited rocking along both the vertical and longitudinal axes of the trailer.

DETAILED DESCRIPTION

In General

Figure 1:
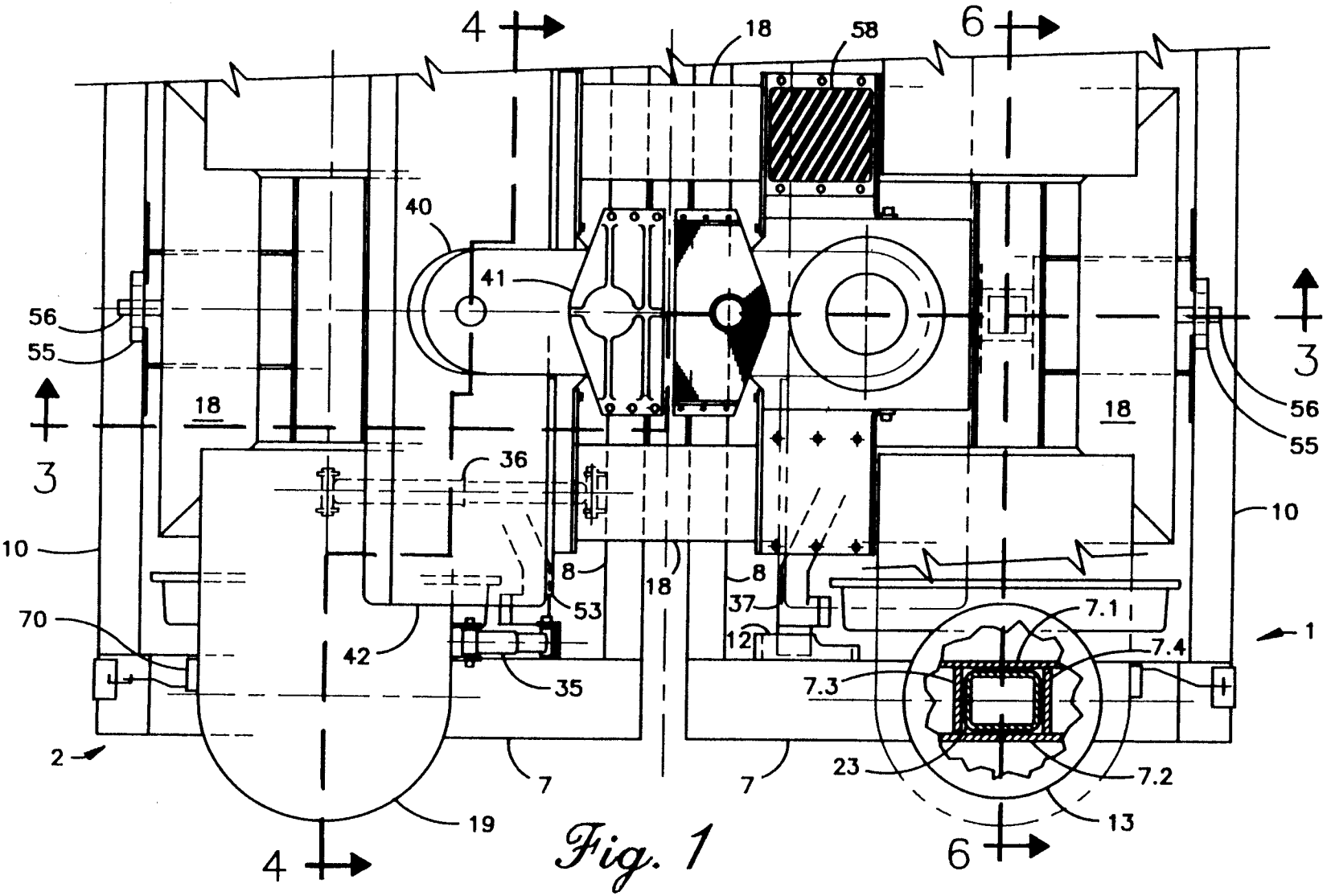
FIG. 1 is a plan view of the retractable intermodal vehicle of this invention, the portion to the left of the centerline being in the lowered or retracted position, and the portion to the right of the centerline being in the raised or extended position.

The drawings disclose a novel Retractable Intermodal Vehicle which is detachable from a specially-modified trailer, which trailer can be used alternatively as a normal highway trailer pulled over the road by a standard highway tractor or as a part of a train of trailers coupled together to form a railroad train when mounted atop intermodal rail vehicles of the type herein described. The trailers may be of any body type; van, dump trailer, flatbed, container chassis or any other.

The major components comprising the retractable intermodal vehicle 1 are front and rear lower frames 2, an upper lifting frame means 3, front and rear trailer support heads 4 carried by the upper lifting frame 3, and a rail axle/wheel assembly 5 and brake assembly 6 for each of the lower frames 2. Spring means extend between the upper lifting frame and the lower frames 2, the principal component of the spring means being four air springs 54.

Each of the lower frames 2 include a pair of side frames 7, a cross bar 8, a steering arm 9, and a tie bar 10. The rail axle/wheel assembly 5 for each of the lower frames 2 is connected to the side frame assemblies 7 via bearing supports 11. Brake beam guides 12 are secured to the inner sides of the side frames 7 as shown in FIG. 1.

The upper lifting frame 3 is comprised of longitudinal and transverse square tubes 18 welded together to form a rectangular airtight reservoir. The frame 3 also includes cross bars 20, 27, 27A and 28 which extend between the longitudinal side tubes 18. Upper spring mounting plates 19 are secured to the longitudinal side tubes 18 and extend to the sides.

Spring means extend between each of the lower frames 2 and the upper lifting frame 3, the spring means including an air spring 54 generally disposed above each bearing support 11. To this end, a circular member 13 is mounted on top of each side frame assembly 7, the member 13 acting as a spring mounting plate. Disposed below the center of each plate 13 is a square tubular portion, which is defined by inner and outer sides 7.1 and 7.2, respectively, of the associated side frame assembly, and also by transverse members 7.3 and 7.4. Telescopically received within each square tubular portion is a side frame strut or column 23. Mounted on the top of each side frame column 23 is a mounting plate 22. A shear mount 30 connects each mounting plate 22 to an associated mounting plate 19 of the upper lifting frame 3 The shear mounts are constructed as a sandwich of rubber bonded between two parallel metal plates. They serve to stabilize the air springs 54 which are disposed about each side frame column 23. Thus, when the shear mounts 30 are flexed or "sheared" sidewards, they have a tendency to return to their original shape. Each shear mount 30 will be wholly within the associated air spring 54.

Figure 2B:
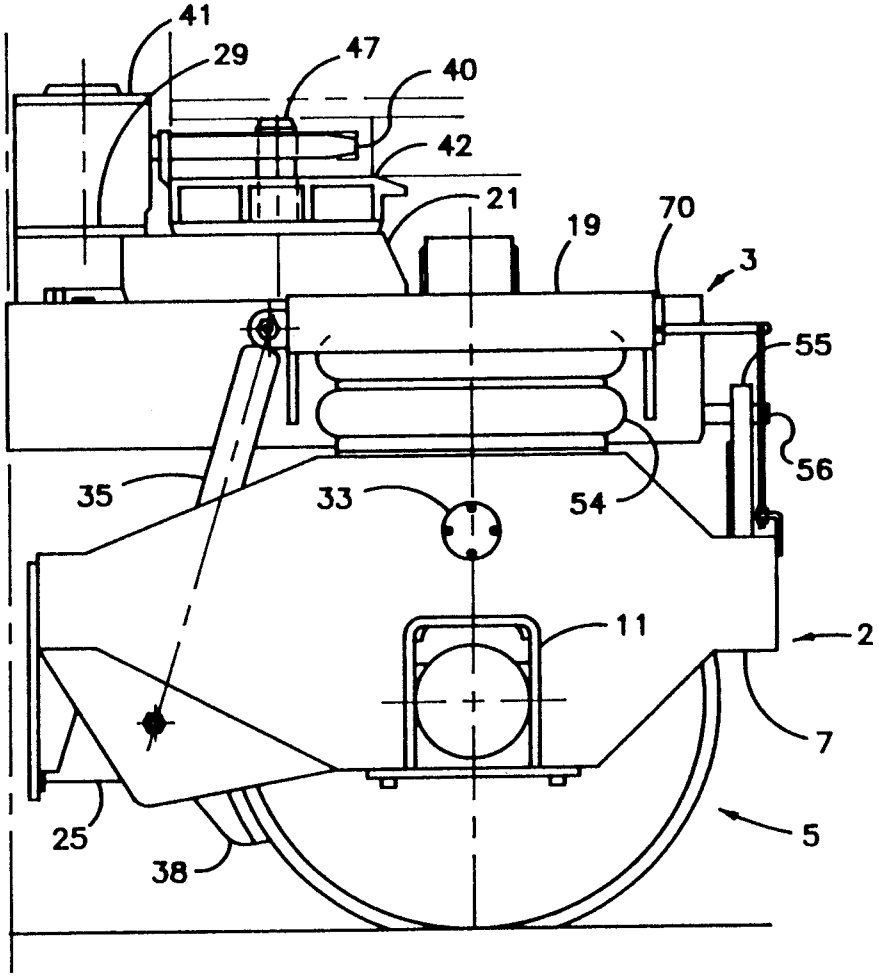
FIG. 2B is a partial side view of the retractable intermodal vehicle in the maximum extended or raised position, this view being taken to the right of the centerline in FIG. 1.
Figure 2A:
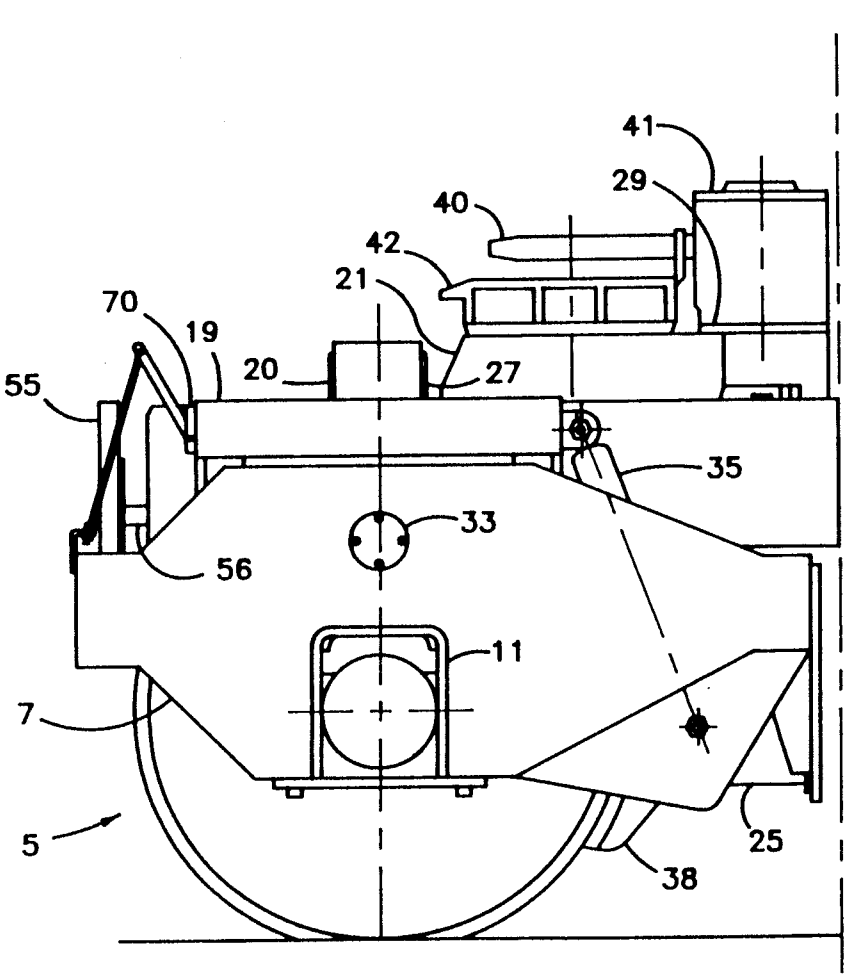
FIG. 2A is a partial side view of the retractable intermodal vehicle in the retracted or lowered position, this view being taken to the left of the centerline in FIG. 1.

The air springs are of a type manufactured by Firestone Industrial Products Company under the tradename AIRSTROKE/AIRMOUNT. When the upper lifting frame is in its lowered position shown in FIG. 2A, the addition of compressed air to the air springs will cause the air springs to raise the lifting frame thereby raising a trailer which may be on it, and at the same time providing a springing means for the trailer when traveling on the railroad track. Thus, when compressed air is introduced into the air springs, the upper lifting frame 3 can be raised to a spring height of approximately 10 inches and when the air is evacuated from the air springs, the lifting frame will lower to a spring height of approximately 3½ inches.

Height control valves 70 are provided to control and regulate the height of the air springs. The valves 70 are installed in accordance with the "Engineering Manual and Design Guide", No. 030 DKM 89, published by Firestone Industrial Products Company, Noblesville, Ind., the manufacturer of the air springs. When trailers are mounted on the trailer support heads 4, the valves 70 cause the heads to be raised until the springs 70 are one inch below their maximum operating height. When in this position, the reaction bars will be one inch below the reaction loops 55.

Four spring dampers 35 are provided to prevent excessive spring action. Each damper is attached at its lower end to one of the side frames 7 and at its upper end to the upper lifting frame 3 by brackets which extend from the upper spring mounting plate 19 as can best be seen in FIG. 1.

Figure 4:
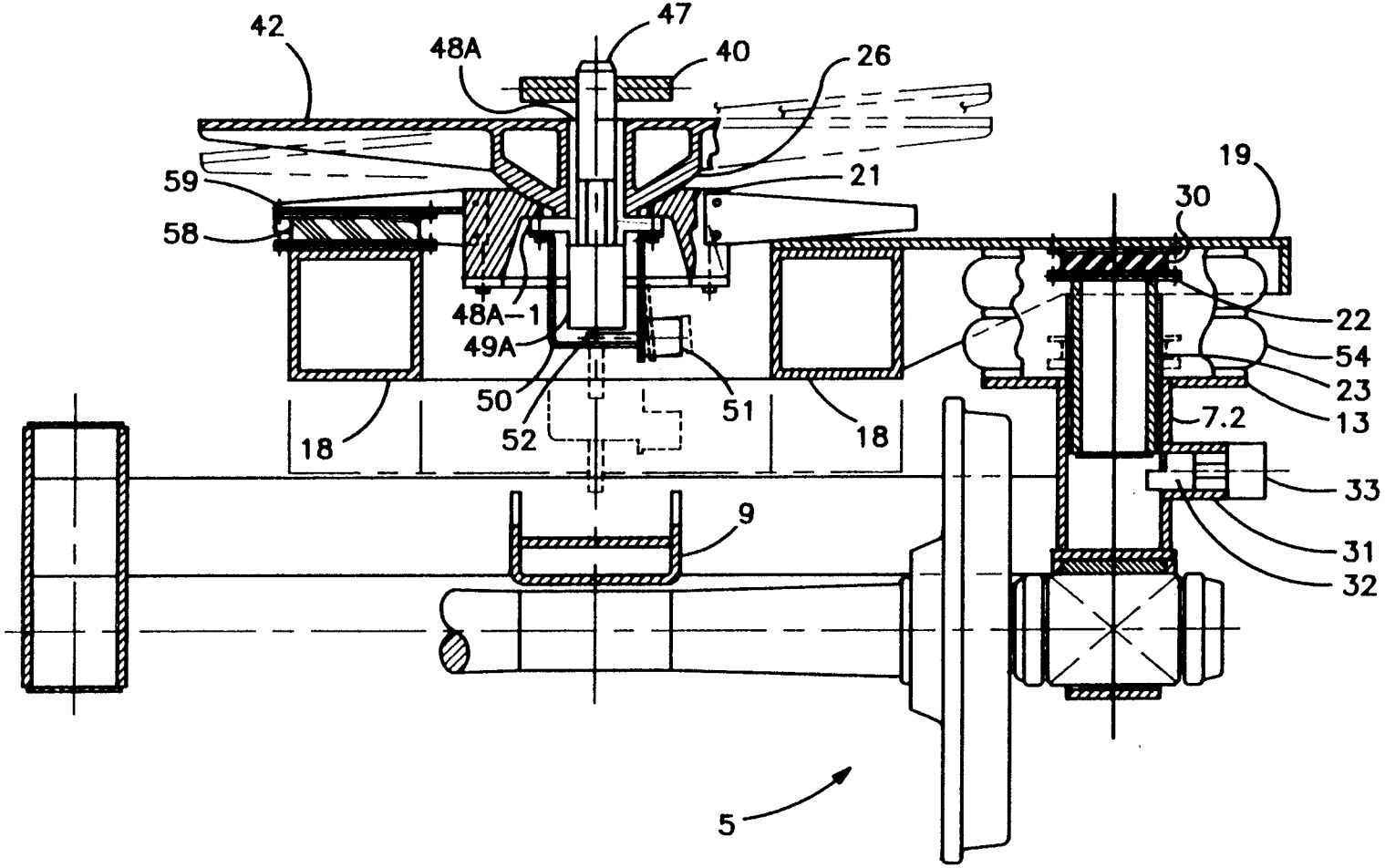
FIG. 4 is a cross-section view of the retractable intermodal vehicle taken along the line 4—4 in FIG. 1, but showing the vehicle in the raised position as when in use in the rail mode.

For purposes of safety in the case of loss of air from any of the air springs, safety locks 31 are provided at each side frame. These locks consist of a spring-loaded pin 32, normally in the extended position. This pin is spaced below and away from the lower surface of the sliding column 23 when the air spring is in the filled (running) position; that is, when the trailer is operating over the rails. Should a loss of air occur in one of the air springs, the column 23 will drop and the weight of the superimposed trailer will be carried by the safety lock pin until the train can be brought to a halt and repairs to the spring made. For lowering the Intermodal Vehicle in order to attach or detach it from the trailer, the safety pin 32 is retracted by air cylinder 33, as shown in FIG. 4.

Figure 3B:
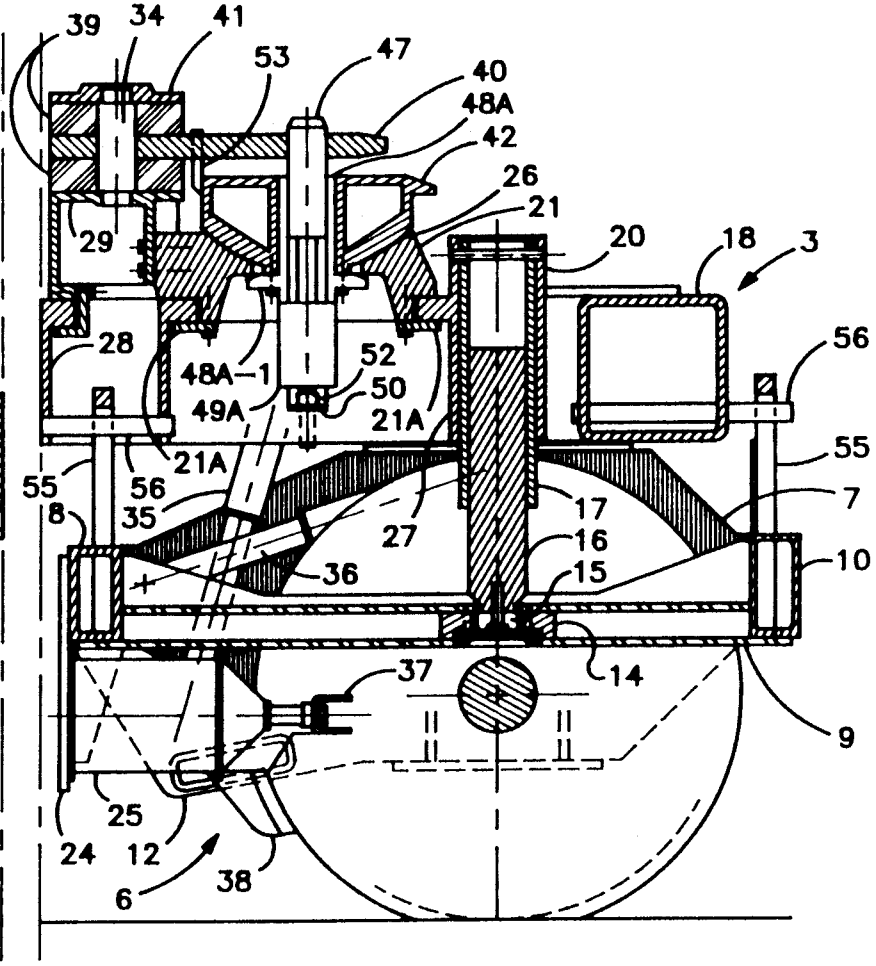
FIG. 3B is a partial longitudinal section of the retractable intermodal vehicle in the maximum raised position, this view being taken generally along the line 3—3 in FIG. 1 to the right of the centerline.
Figure 6:
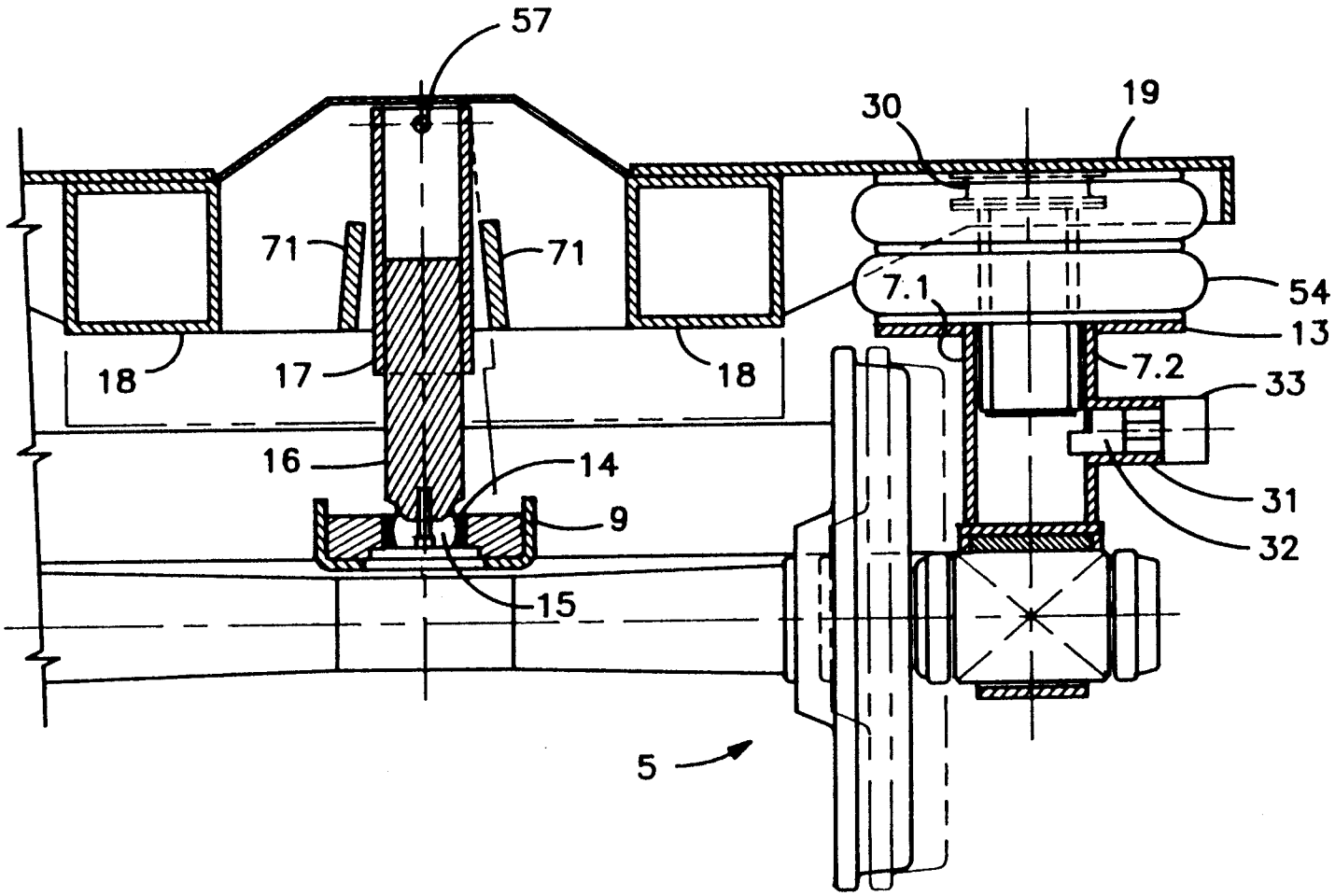
FIG. 6 is a partial cross-section of the steering link taken along view line 6—6 in FIG. 1.

Steering means are provided for steering the lower frames 2 relative to the upper frame 3. To this end, as can best be seen from FIG. 6, the steering arm 9 has at its center a ball race 14 with a ball within forming a universal joint. The ball 15 is fastened to a square bar 16 which is able to telescope within guide tube 17, the tube 17 being part of the lifting frame 3. Steering of the lower frames 2 below the lifting frame 3 occurs as the lower frames 2 pivot about ball 15, thus allowing the lower frames 2 to steer the rail axles 5. Guide tube 17 is pivoted on shaft 57 which extends between upper frame crossbars 20 and 27 as shown in FIG. 3B, and enables the axle to shift from side-to-side to effect a "differential action" of the tapered railroad wheels on the rail tracks. Bars 71, (FIG. 6) welded between frame crossbars 20 and 27, serve to limit the sideward shift of the axle.

Figure 3A:
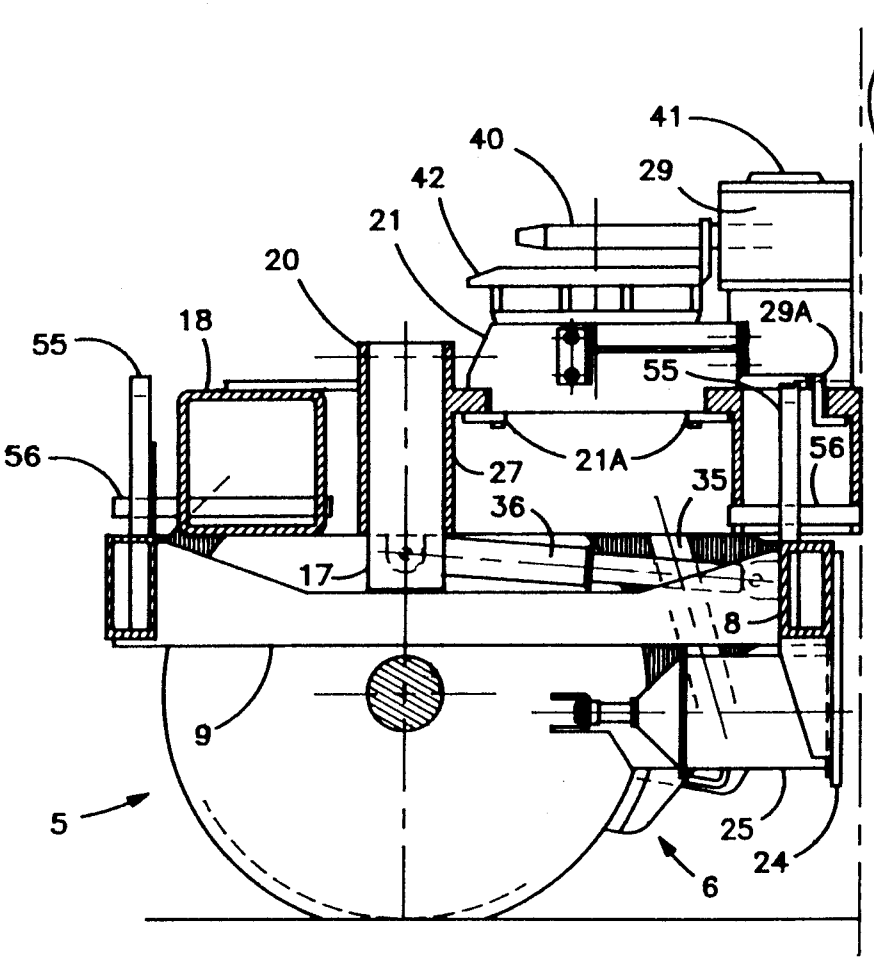
FIG. 3A is a partial longitudinal section of the retractable intermodal vehicle in the lowered position, this view being taken generally along the line 3—3 in FIG. 1 to the left of the centerline.

Four steering dampers 36, two of which are shown in FIGS. 3A and 3B, and with their centerlines roughly parallel to the longitudinal axis of the retractable intermodal vehicle, are attached at one end to the cross bars 8 and at the other end to the lifting frame, serve to control any excessive motion of the steering means.

Each of the trailer support head 4 is mounted for limited side-to-side sliding movement on the upper lifting frame 3. To this end, socket 21 and coupler body 29 are slidable supported by cross bars 27, 27A, and 28 as can best be seen by FIG. 3B. To retain the members 21 and 29 on the cross bars, retainers 21A, and 29A are provided, the retainers being secured to the associated members. A trunnioned coupler pin 34 extends upwardly from the coupler body 29 and is secured in place by a removable top plate 41. Sandwiched between the top plate 41 and the top of the coupler body 29 are upper and lower rubber pads 39 and a coupler tongue 40. The rubber pads and the tongues have holes through which the coupling pins pass. The combination of the two rubber pads and the tongue have a total height which is slightly more than the space provided between the top surface of the coupler body 29 and the removable upper plate so that when the upper plate is bolted in place, the rubber pads will be slightly compressed. The hole in the coupler tongue 40 is of a slight "hourglass" shape in its vertical cross-section. This shape allows the tongue to rock along both the vertical and longitudinal axes of the intermodal vehicle to accommodate such motions as the train of intermodal trailers, coupled together, travels along a railroad track. It will be noted that only a rocking motion can occur in the aforesaid coupler body, while only a swinging motion can occur in the coupler sockets at the ends of the trailers.

Figure 5C:
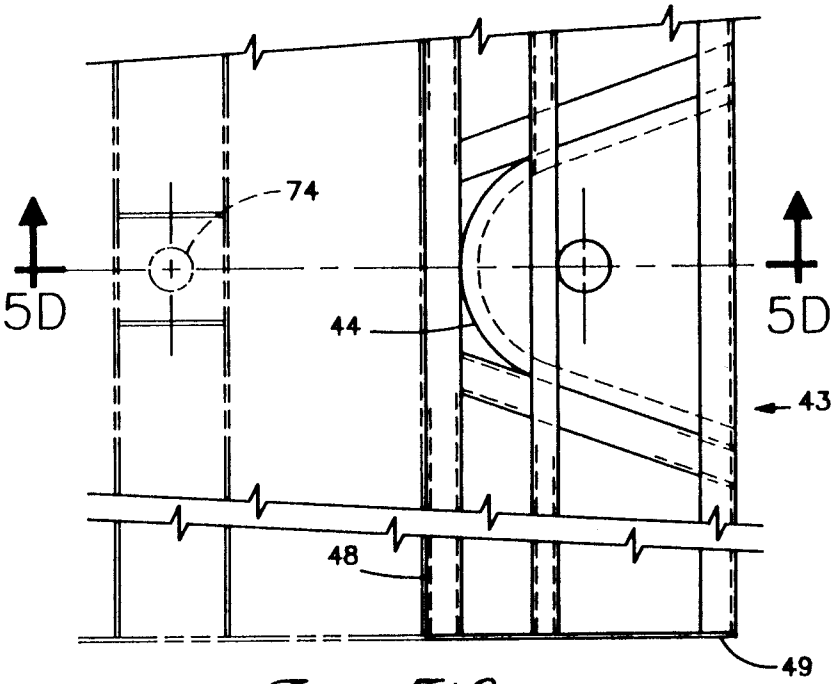
FIG. 5C is a partial plan of the front end of a trailer of this invention, the socket in the front end of the trailer being configured to receive an interconnecting tongue which is part of the retractable intermodal vehicle, the front end of the trailer being supported by the retractable intermodal vehicle when in use in the rail mode.
Figure 5D:
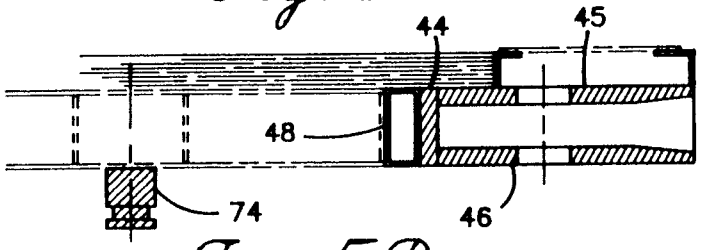
FIG. 5D is a section taken generally along the line 5D—5D in FIG. 5C.
Figure 5A:
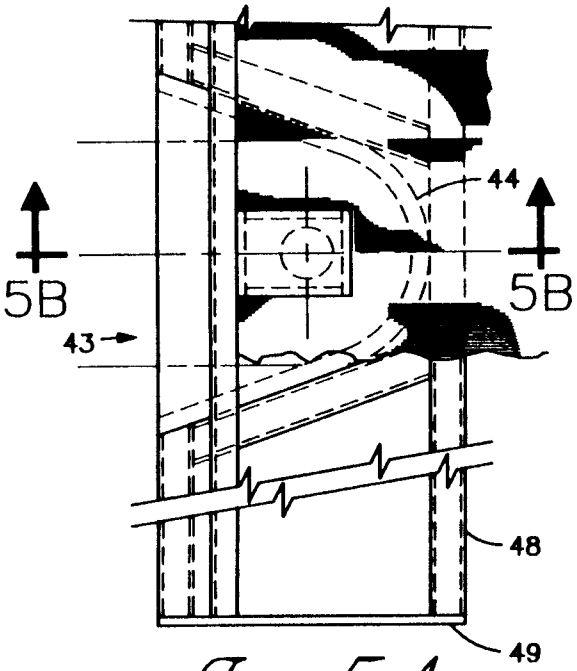
FIG. 5A is a partial plan of the rear end of a trailer of this invention, the socket in the rear end of the trailer being configured to receive an interconnecting tongue which is part of the above retractable intermodal vehicle, the rear end of the trailer being supported by the retractable intermodal vehicle while in use in the rail mode.
Figure 5B:
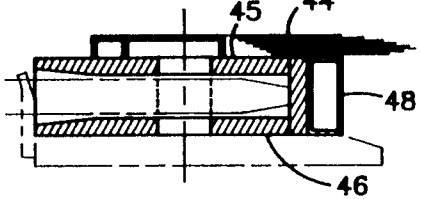
FIG. 5B is a section taken generally along the line 5B—5B in FIG. 5A.
Figure 7:
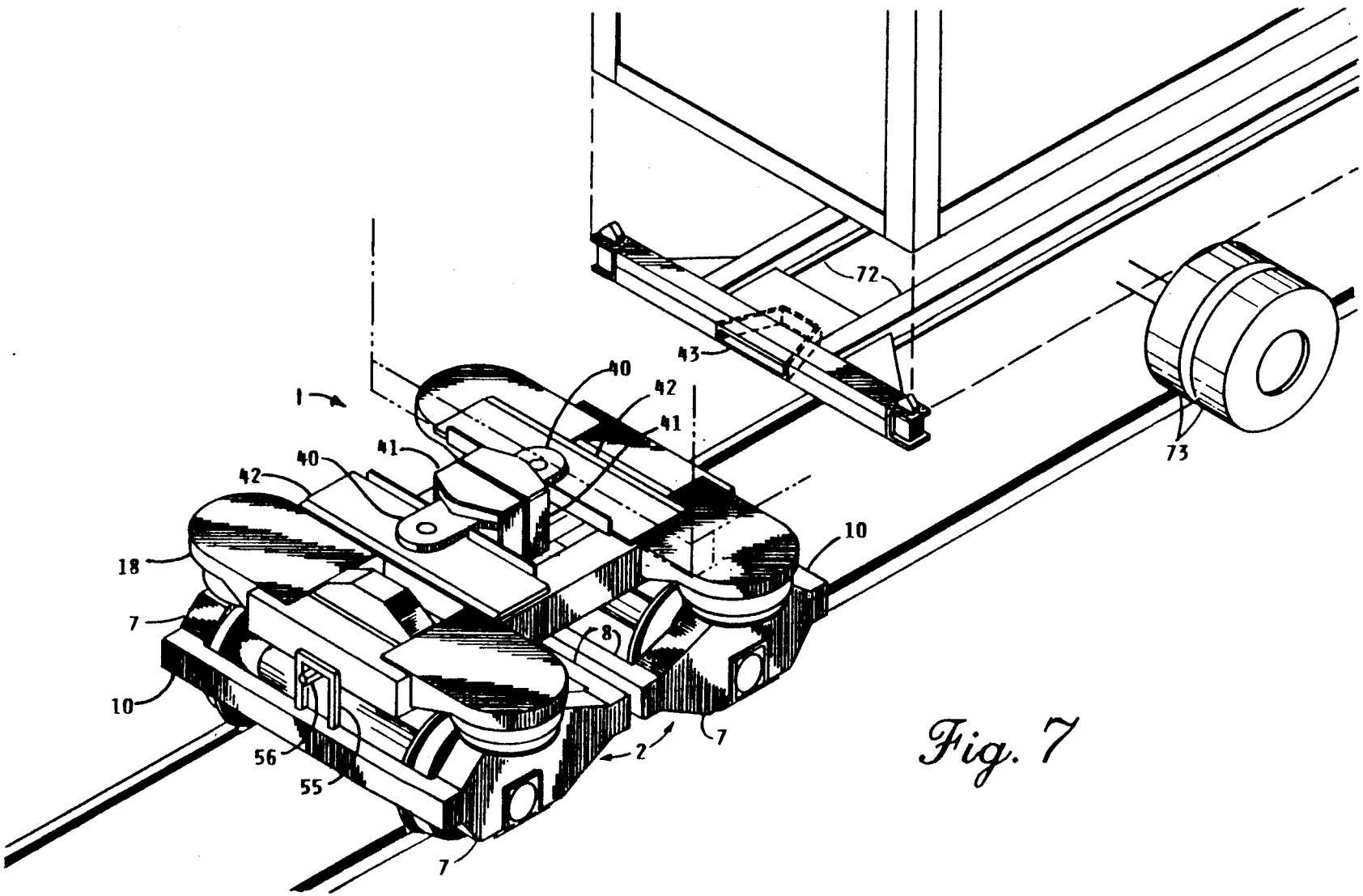
FIG. 7 is an isometric view of the intermodal vehicle together with the rear end of a trailer, showing the major components of each.

FIGS. 5A and 5B show a coupler socket at the rear of a typical trailer and FIGS. 5C and 5D show a coupler socket at the front of a typical trailer. Coupler sockets 43 are the same for both front and rear of a trailer. The trailer, as shown in FIG. 7, includes a longitudinally extending main frame member 72, a highway wheel assembly including wheels 73, and a fifth wheel king pin 74 behind the front coupler socket 43. The trailer socket consists of a side plate 44, flared to allow the coupler tongue to swivel within the coupler assembly, a top plate 45, and a bottom plate 46. Both the top plate and the bottom plate have holes, as does the coupler tongue 40, when inserted into the coupler body and all of which are co-axial with one another, and into which the movable coupling pin 47, when urged upward from the intermodal vehicle below passes, thus effecting a coupling between the intermodal vehicle and the trailer. The coupler body 43 is fastened to the structure of the trailer by transverse beams 48, which are attached to the trailer side structure by plates 49, all as shown in FIG. 5A and FIG. 5B.

Each trailer support head 4 further includes a support plate and bowl assembly having an essentially flat surface 42 which may engage the lower surface of a highway trailer and thus supports its weight. The support plate and bowl assembly also has an integral spherically-shaped bowl 26, which fits into and rides within socket 21. The assembly 26, 42 is provided with a central aperture, an extension/guide tube 48A being secured therein. Bowl 26 is prevented from coming out of socket 21 by a plate 48A1 which is part of extension/- guide tube 48A. Riding within extension tube 48A is the coupling pin 47, which is actuated upwardly and downwardly by pneumatic cylinder 49A fastened to the extension tube 48A. Also attached to tube 48A is lock frame 50 which surrounds cylinder 49A. To the lock frame is mounted pneumatic cylinder 51 which actuates safety lock 52, said lock acting against the extended rod of cylinder **49*a* to prevent accidental retraction of the coupling pin should loss of air occur when the train of trailers is in operation in the rail mode; all as shown in FIG. 4. The trailer support head is prevented from rotating below the mating trailer surface by lugs 53 which engage the outer edges of coupler tongue 40**.

The braking system 6 for the retractable intermodal vehicle consists of brake cylinders 25 attached to transverse plates 24 mounted on cross bar 8 of each lower frame 3, there being a cylinder for each axle. The cylinders act against brake beams 37 which are guided in the side frame assemblies 7 by brake beam guides 12 similar to those found on standard rail trucks. Brake shoes 38 are attached to the brake beams 37 in the normal manner. The reservoir formed by the tubes 18 may be used as the brake air reservoir. Air used to fill the reservoirs may also be used to fill the air springs 54.

To help react any forces from braking of the rail wheels, such as an overturning moment, reaction bars 56 are attached at the centerline of lifting frame 3. Correspondingly, reaction loops 55 are fastened fore and aft on the centerline of the main frames, said loops arranged so that the upper surface of a reaction bar is in contact with the inner lower surface of a reaction loop when the lifting frame is in the raised position. The reaction loops are of such an inner width that they will not interfere with the normal steering of the main frame. Additionally, these reaction loops also serve as a limitation against excessive upward travel of the air springs when they are filled with air, all as shown in FIG. 3A and FIG. 3B.

The function of the Retractable Intermodal Vehicle is as follows: The main or lower frame frames 2 are supported by the rail axles 5 via the bearing supports 11. Air springs 54, are fastened at their lower end to mounting plates 13 and at their upper end to the upper mounting plates 19 on lifting frame 3. The main frames are pivoted around ball joint 15 which is attached to bar 16, telescoping in tube 17. The trailer support head 42 is fastened to bowl 26 and is able to rotate in socket 21.

Figure 8:
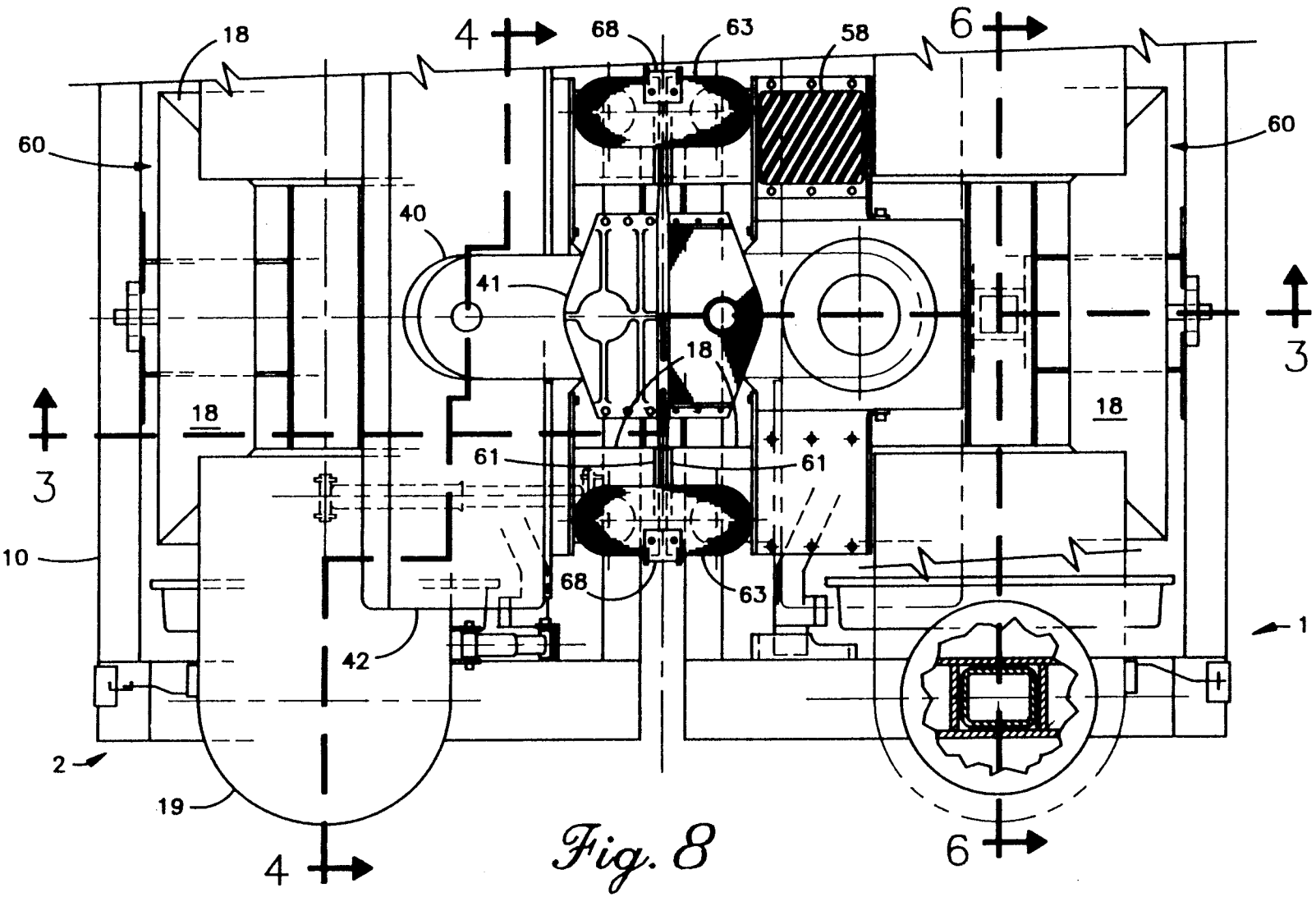
FIG. 8 is a plan view of an alternate design for the retractable intermodal vehicle.
Figure 9:
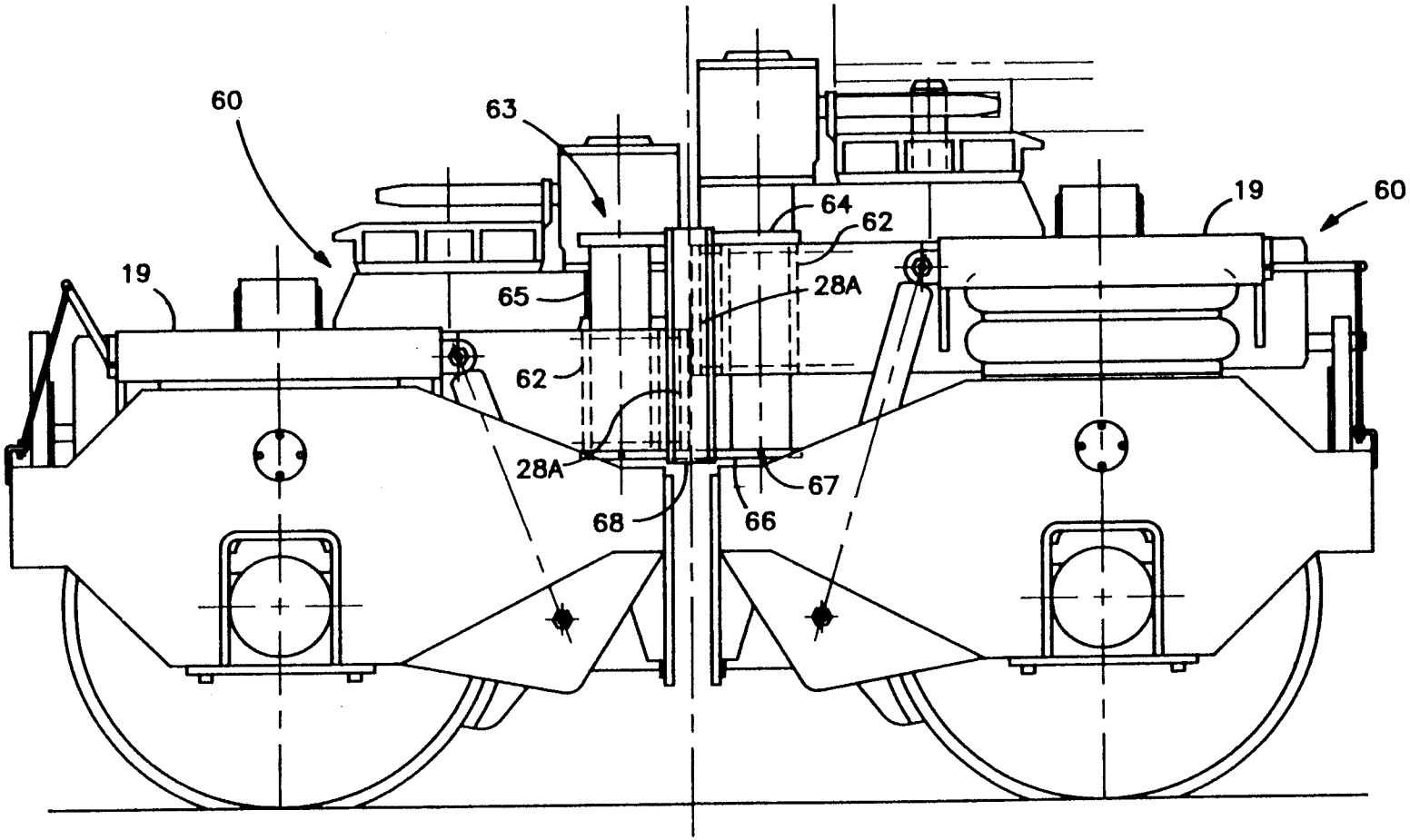
FIG. 9 is a side view of an alternate design for the retractable intermodal vehicle.

FIG. 8 is the plan view and FIG. 9 is a side view of a Retractable Intermodal Vehicle of an alternate design. All major components of this alternate vehicle are the same as those described before, except that in lieu of the lifting frame means 3 being a one-piece unit, the lifting frame means includes two identical upper frame units 60. Lifting frames 60 are constructed from rectangular steel tubing 18 and have bulkheads 61 so as to form two "C" shaped independent reservoirs. Each lifting frame 60 also has two upper spring mounting plates 19 and crossbars 20, 27 and 27A, together with one crossbar 28A which is described as one-half of crossbar 28 used on the first vehicle design which has a one-piece lifting frame 3.

Lower frames 2; trailer support head 4; axle assembly 5; and brake assemblies 6 are mounted to the upper frames 60 as before. Each lifting frame 60 also has two vertical tubes 62, welded at the top and bottom surfaces of the reservoir so as to be air-tight. The two lifting frames 60 are fastened together by sliding joint assemblies 63, comprised of upper plate 64 and two vertical tubes 65 welded thereto, together with removable lower plate 66, bolted to the ends of tubes 65 with bolts 67. The upper and lower plates of joint assemblies 63 are connected to one another by guide bars 68. The ends of the lifting frames 60 are in close proximity to one another near the transverse centerline of the Retractable Intermodal Vehicle.

This alternate design for the Retractable Intermodal Vehicle, which has a two-piece upper lifting frame, allows the trailers superimposed upon it to be raised or lowered separately. This separation of the two adjacent trailers by this two-piece frame will simplify train make-up and break-up procedures by allowing the trailers to be lifted or lowered individually, but more importantly, will improve the vehicle dynamics of the train of trailers in the event that a train is made up of trailers of different gross vehicle weights.

The procedure for attaching either of the two alternate designs of the Retractable Intermodal Vehicle to a mating intermodal trailer is shown in FIG. 7. The Intermodal Vehicle is placed on the railroad track. A trailer is backed over the retracted intermodal vehicle so that the coupling tongue 40 on the vehicle enters the opening in either end of a trailer and the transverse plate 42 supports the trailer at its lower surface. In order to facilitate the alignment of a trailer socket with a coupling tongue, the coupling assembly, consisting of the support plate 42 riding within socket 21 and the coupling tongue 40, mounted within coupler body 29 are configured to enable them to slide from side-to-side on upper frame crossmembers 20, 27, 27A and 28. This sideward movement is limited by contact of socket 21 with the upper frame members 18. Rubber shear springs 58, mounted between frame members 18 and brackets 59 fastened to socket 21, return the aforesaid coupler assembly to center and maintain it there, as shown in FIGS. 3B and 4.

It should be noted that the coupling socket into which the coupler tongues enter, are the same at both the front and the rear of the trailer, so that it makes no different whether the front or the rear of any trailer within a train of these trailers travels forward or rearward with relationship to the direction of train travel.

The foregoing describes a novel Intermodal Vehicle which meets the purposes set forth above.

What is claimed is:

1. A train of highway trailers including leading and trailing trailers which are interconnected to each other and supported by improved intermodal vehicles, each of said highway trailers including a main frame and one or more highway wheel assemblies, and each of said intermodal vehicles being provided with two rail wheel assemblies mounted in two steerable lower frames, upper frame means from which the steerable lower frames are pivoted, leading and trailing gravity load carrying structures respectively engaging the leading and trailing trailers, leading and trailing coupler tongues which are received respectively in coupler sockets at the adjoining ends of said trailers and are pinned thereto by coupling pins movable in a vertical direction through vertically aligned apertures in the said trailer coupler sockets and the intermodal vehicle coupler tongues thereby effecting a coupling between the intermodal vehicle and the trailer surmounting it, and each intermodal vehicle having air spring means between its lower frames and its upper frame means, said air springs arranged so that when the air is removed from the springs, the upper frame means of the intermodal vehicle will descend and when air is introduced into the air springs, the upper frame means of the intermodal vehicle will rise, at the same time raising the superimposed trailers resting upon the load carrying structures of the intermodal vehicle.

2. The train as set forth in claim 1 further characterized by the trailers having identically configured coupler tongue receiving means at both the front and rear of the trailers so that either a front or a rear of any trailer is attachable to any coupler tongue on any of the several intermodal vehicles which are used to make up the train of highway trailers.

3. The train as set forth in claim 1 further characterized by the lower support frames of the intermodal vehicles being pivoted at the intersection of the vehicle centerline with the respective centerlines of axles of the rail wheel assemblies a pivot assembly being fastened at its top to the upper frame means of the intermodal vehicle and at its bottom to a part of the lower frame, said pivot assembly constructed so it is telescopable within itself when the upper frame means of the intermodal vehicle rises or descends, and further having at its lower end a ball-type universal joint.

4. The train as set forth in claim 1 further characterized by the two gravity load carrying structures of the intermodal vehicle being mounted in spherical seats and said seats attached to the upper frame means of the intermodal vehicle so that the gravity load carrying structures are capable of rocking from side-to-side and rolling fore and aft in concert with the motions of the superimposed trailer as it travels along railroad tracks.

5. The train as set forth in claim 4 further characterized by the intermodal vehicle having said coupler tongues mounted in coupler bodies attached to the upper frame means of the intermodal vehicle, each said coupler tongue having an hourglass-shaped aperture at one end into which is fitted a vertical pin within said coupler body, the coupler tongues being sandwiched top and bottom within the coupler body between elastomeric pads, said pads having the function of holding the coupler tongues in a horizontal position, while at the same time, allowing said tongues to rock and roll in relation to said vertical pin within the hourglass-shaped aperture in concert with the motion of the trailer when traveling over the railroad tracks.

6. The train as set forth in claim 5 further characterized by the spherical seat and the coupler body being attached together and the assembly of the two being configured to ride upon transverse support bars on the intermodal vehicle so as to afford them an ability to shift from side-to-side perpendicular to the longitudinal centerline of the intermodal vehicle, said shifting ability to facilitate the alignment of the trailer as it is backed over the intermodal vehicle for attachment thereto.

7. The train as set forth in claim 6 further characterized by the assembly of the spherical seat and the coupler body being held in a central, or neutral, position atop the upper frame means of the intermodal vehicle by springs, said springs being preferably of a rubber-in-shear type.

8. The train of claim 5 in which the pin is prevented from dropping upon loss of air pressure by safety latch means.

9. The train as set forth in claim 1 further characterized by each gravity load carrying structure of the intermodal vehicle having below a trailer resting surface the vertically oriented coupling pin, said pin being operated up or down by an air cylinder, and the pin capable of being raised sufficiently to effect a coupling between said gravity load carrying structure, the trailer superimposed upon it, and one of the coupler tongues of the intermodal vehicle within the complimentary coupler tongue receiving socket of the trailer.

10. The train as set forth in claim 1 further characterized by each intermodal vehicle having restraint loops attached to its lower frame and horizontal bars within said loops attached to the upper frame means of the intermodal vehicle, said loops and bars acting to limit the maximum upward movement of the upper frame means under the influence of the air springs and further to act in restraint of an overturning moment of the lower frames when railroad brakes are applied.

11. The train as set forth in claim 1 further characterized by each intermodal vehicle having a rail wheel bearing and a telescopic strut at the centerline of each rail wheel bearing where it is attached to a lower side frame assembly, said strut consisting of an outer tube which is part of the side frame assembly and an inner member which slides vertically within said outer tube, and which strut inner member is within the air spring.

12. The train of claim 11 wherein the inner sliding member is surmounted by a rubber-in-shear spring, the lower surface of which is attached to the upper end of said inner sliding member and the upper surface of which is attached to the underside of an air spring upper mounting plate, so that motion of the upper plate with relationship to the vertical centerline of the strut will be resisted by said rubber-in-shear spring and the upper element returned to its normal position by said spring.

13. The train as set forth in claim 1 further characterized by the intermodal vehicle having an integrally-mounted braking system consisting of conventional brake shoe assemblies, transverse brake beams with their ends sliding within guides attached to the lower frames of the intermodal vehicle and with brake operating cylinders attached to said lower frames.

14. The train as set forth in claim 1 further characterized by the upper frame means of the intermodal vehicle being hollow and used as a reservoir for compressed air, said compressed air used in the operation of the intermodal vehicle for braking.

15. The train as set forth in claim 14 further characterized by the intermodal vehicle being fitted with height control valves which add or remove air to or from the several air springs as required to maintain a preset ride height of the intermodal vehicle.

16. The train as set forth in claim 1 further characterized by the upper frame means of the intermodal vehicle being made in two parts rather than one, in order to permit trailers superimposed upon said intermodal vehicle to be raised, supported and braked individually.

17. An improved train of highway trailers including leading and trailing trailers interconnectable to each other and which are supported by intermodal vehicles when connected to each other, each of said highway trailers including a main frame and one or more highway wheel assemblies, and each of said intermodal vehicles being provided with forward and rearward projecting coupler tongues which are arranged to enter coupler tongue sockets at the adjoining ends of said highway trailers and effect a coupling between the intermodal vehicle and the trailer surmounting it, and in which each intermodal vehicle has two single axle rail wheel assemblies each mounted in its own steerable frame and means for transmitting steering forces from said frames to the trailers surmounting said vehicles.

18. The train as set forth in claim 17 further characterized by the trailers having identically configured coupler tongue receiving means at both the front and rear of the trailers so that either a front or a rear of any trailer is attachable to any coupler tongue on any of the several intermodal vehicles which comprise said train of highway trailers.

19. A train of highway trailers including leading and trailing trailers which are interconnected and supported on intermodal vehicles, each vehicle having leading and trailing flat upwardly presented gravity load carrying structures respectively engaging the bottoms of the leading and trailing trailers in gravity load carrying relation, and leading and trailing drawbar coupling prongs which are received respectively in drawbar coupling sockets at the adjoining ends of said trailers below the trailer floors, said prongs being coupled to respective said sockets, each prong being pivoted on a pin on said vehicle for limited pivotal, rolling and pitching movement without carrying gravity load, and each prong being pivoted by a rubber joint yielding in all directions.

20. An improved intermodal vehicle adapted to be removably coupled to leading and trailing highway trailers to convert the trailers to rail mode travel, each of said intermodal vehicles including two rail wheel assemblies mounted in two steerable lower frames, upper frame means from which the steerable lower frames are pivoted, leading and trailing gravity load carrying structures respectively capable of engaging leading and trailing trailers, and each intermodal vehicle having air spring means between its lower frames and its upper frame means, said air springs being arranged so that when the air is removed from the springs, the upper frame means of the intermodal vehicle will descend and when air is introduced into the air springs, the upper frame means of the intermodal vehicle will rise, at the same time raising the superimposed trailers resting upon the load carrying structures of the intermodal vehicle.

* * * * *